US005857231A

United States Patent [19]

Wade

[11] Patent Number: 5,857,231

[45] Date of Patent: Jan. 12, 1999

[54] HAMMOCK COVER

[76] Inventor: Mary V. Wade, HC 75 Box 673A, Locust Grove, Va. 22508

[21] Appl. No.: 986,409

[22] Filed: Dec. 8, 1997

[51] Int. Cl.[6] ..... A45F 3/22

[52] U.S. Cl. ..... 5/120; 5/658; 5/922; 150/154; 150/158

[58] Field of Search ..... 5/120, 122, 121, 5/658, 123, 922; 150/154, 158

[56] References Cited

U.S. PATENT DOCUMENTS

| | | | |
|---|---|---|---|
| D. 203,966 | 3/1966 | Riedel | D5/1 |
| D. 328,828 | 8/1992 | Turk | D6/382 |
| D. 359,411 | 6/1995 | Wade | D6/610 |
| 428,993 | 5/1890 | Wright . | |
| 1,071,764 | 9/1913 | Lowrimore | 5/122 |
| 1,257,984 | 3/1918 | Drexler . | |
| 1,748,501 | 5/1928 | Stevens . | |
| 3,022,808 | 2/1962 | Silver | 150/52 |
| 3,675,256 | 7/1972 | Tallarico et al. | 5/120 |
| 4,125,909 | 11/1978 | Jacobson | 5/121 |
| 4,308,883 | 1/1982 | Malone | 5/121 |
| 4,686,720 | 8/1987 | Newell | 5/122 |

OTHER PUBLICATIONS

Internet advertisement "Hatteras Hammocks, Inc." (brochure).

Internet advertisement "Caribe Hammocks" (brochure).

Internet advertisement "Manufacturers of the World's Best Hammocks" (brochure).

*Primary Examiner*—Alexander Grosz

*Attorney, Agent, or Firm*—Klima & Pezzlo, P.C.

[57] ABSTRACT

A hammock cover including a flexible elongated major portion having a first transverse edge and a second transverse edge and configured to releasably attach to a conventional hammock for covering a body portion of the hammock, a first flexible minor portion configured to releasably attach to a first line portion of the hammock and to substantially overlap the first transverse edge of the major portion for covering the first line portion of the hammock, and a second flexible minor portion configured to releasably attach to a second line portion of the hammock and to substantially overlap the second transverse edge of the major portion for covering the second line portion of the hammock.

30 Claims, 2 Drawing Sheets

HAMMOCK COVER

FIELD OF THE INVENTION

This invention relates generally to covers. In particular, a cover for a hammock is described which may be releasably attached to a hammock to allow the hammock to remain slung outdoors for extended periods of time without being damaged.

BACKGROUND OF THE INVENTION

Hammocks have been in wide use for many years. More recently, the hammock has become strongly associated with leisure time. Indeed, many advertisers attempt to associate their products with the pleasant thoughts of leisure time by featuring an individual or individuals relaxing on a hammock slung between two trees in the back yard of a home during a comfortable sunny weekend afternoon.

Although there are a wide variety of sizes and types of hammocks, many commonalities exist among hammocks available to the individual. From these commonalities, a hypothetical conventional hammock may be described. Typically, the conventional hammock includes an elongated body portion, which is made of a series of ropes which are knotted together at predetermined points and/or woven to form a net-like structure in which an individual(s) places his or herself in a typically supine position for relaxing while on the hammock. However, the conventional hammock may include a body portion which is constructed of a piece of fabric or other suitable material.

In any case, the elongated body portion of the conventional hammock is typically rectangular in shape and has a first end and a second end. In the case of a hammock having a body portion constructed of ropes, the ropes are either integral or otherwise connected to first and second line portions which extend from the first and second ends of the body portion, respectively. The first and second line portions are each constructed of a series of equidistant spaced apart ropes which converge to first and second rings, typically made of steel. The rings, in turn, are connected to first and second leaders, which are typically lengths of chain. Also included on the conventional hammock are first and second spreader bars which are interposed between the hammock body first end and first line portion and the hammock body second end and second line portion, respectively. The spreader bars prevent the first and second line portions and first and second ends of the hammock body portion from becoming twisted or overly deformed, and thus contribute greatly to the comfort which may be experienced by lying on the hammock.

The conventional hammock is typically slung by the first and second leaders between first and second hooks on first and second supports, respectively. Typically, the first and second supports are fixed. Perhaps the most classic first and second fixed supports are two trees. However, if adequate trees are unavailable then it is common to anchor suitable first and second fixed supports under a shade tree. Regardless of what type of supports are used, it is the distance between the supports and specifically the first and second hooks which determines how taut the hammock will be slung between the supports, i.e. if the supports are sufficiently far apart then the hammock will be almost horizontal upon being slung therebetween. An important aspect of this distance is that it determines how much the center of the hammock will deflect under the load of an individual lying on the hammock so that if the hammock is tautly drawn between the hooks, the center of the hammock will deflect only slightly downwardly and the individual will be lying substantially flat. Whereas, if the hammock is slung loosely between the hooks, then the center of the hammock will deflect greatly and the individual lying thereupon will likely be in a substantially arcuate position, and consequently, will likely be uncomfortable. It is important then to find supports or to space apart supports so that an adequate amount of tension may be produced between the first and second ends, i.e. rings, of the hammock for comfortable hammock use.

While finding or fabricating suitable supports may be initially problematic, once solved, the solution is relatively permanent. There exists another problem, however, which is unfortunately somewhat recurring which impedes the achievement of hammock enjoyment. This problem involves generating the necessary force to sling a hammock between two adequately spaced apart hooks on suitable supports, especially for conventional hammocks which have a larger capacity, e.g., "two-person" hammocks. It is somewhat troublesome, and for some individuals impossible, to secure a first ring at the end of a first leader of the hammock to a first hook and then to generate the necessary force to secure a second ring at the end of a second leader of the hammock to a second hook to adequately sling the hammock.

Unfortunately, even if this task must be performed by or with the help of another individual, it must be repeated every time the hammock is used since it is desirable to remove the hammock from the supports and to take it indoors for storage between uses. For if the hammock is not taken down and brought indoors for storage it is exposed to the elements of the environment between uses. As an example of the problems which may be caused by such exposure consider that, insects, birds, or other wildlife may damage the hammock, thereby rendering the hammock unsafe or at least devalued. As another example, if the hammock is slung between two trees, then the hammock may accumulate drippings of sap, or other substances which might not only corrode the materials of the hammock but might also dirty or possibly stain the clothing of an individual lying upon the hammock.

This problem would be solved if it were not necessary to remove the hammock from between the supports and store it between uses. Other problems would also be solved by being able to leave a hammock slung outdoors between uses. For example, precious indoor storage space would be preserved.

SUMMARY OF THE INVENTION

Thus, it is a first object of the present invention to provide a device for allowing a hammock to be left outdoors between uses.

It is a second object of the present invention to provide a hammock cover.

It is a third object of the present invention to provide an improved hammock cover.

It is a fourth object of the present invention to provide a hammock cover which protects a hammock from the elements of the environment.

It is a fifth object of the present invention to provide a hammock cover which is easy to secure to and easy to remove from a hammock.

It is a sixth object of the present invention to provide a hammock cover which is easy to manufacture and inexpensive.

It is a seventh object of the present invention to provide a hammock cover which includes a minimum number of parts.

It is an eighth object of the present invention to provide a hammock cover which allows an adequate amount of air to reach the hammock to prevent the buildup of moisture on the hammock.

It is a ninth object of the present invention to provide a hammock cover which is safe to use.

It is a tenth object of the present invention to provide a hammock cover which is durable.

It is an eleventh object of the present invention to provide a hammock cover which is aesthetically pleasing.

It is a twelfth object of the present invention to provide a hammock cover which, when secured to a hammock, leaves only the following items of the hammock cover and hammock exposed: the material of the cover, a portion of the first leader, a portion of the second leader.

It is a thirteenth object of the present invention to provide a hammock cover which may be used to cover a wide variety of conventional hammocks.

It is a fourteenth object of the present invention to provide a hammock cover which need only be partially removed from the hammock to allow for use of the hammock.

It is a fifteenth object of the present invention to provide a hammock cover which protects at least the following parts of a hammock: the body portion, the first line portion, the second line portion, the first spreader bar, and the second spreader bar.

It is a sixteenth object of the present invention to provide a hammock cover which includes a flexible elongated major portion having a first transverse edge and a second transverse edge and configured to releasably attach to a conventional hammock for covering a body portion of the hammock, a first flexible minor portion configured to releasably attach to a first line portion of the hammock and to substantially overlap the first transverse edge of the major portion for covering the first line portion of the hammock, and a second flexible minor portion configured to releasably attach to a second line portion of the hammock and to substantially overlap the second transverse edge of the major portion for covering the second line portion of the hammock.

It is a seventeenth object of the present invention to provide a method of covering a hammock including the steps of placing a first flexible triangular sleeve portion having a transverse base opening accommodating a first spreader bar of a hammock and a peak opening accommodating a first leader of said hammock over the first leader, a first line portion, and the first spreader bar of the hammock, placing a second flexible triangular sleeve portion having a transverse base opening accommodating a second spreader bar of the hammock and a peak opening accommodating a second leader of the hammock over the second leader, a second line portion, and the second spreader bar of the hammock, placing a flexible elongated rectangular hammock cover major portion on a body portion of a hammock such that a first transverse edge provided with a plurality of hammock connectors covers a first spreader bar of the hammock, and a second transverse edge provided with a plurality of hammock connectors covers a second spreader bar of the hammock, connecting the hammock connectors to the first and second spreader bars of the hammock, engaging a border of outwardly facing hook type fastening material on the first transverse edge of the major portion with a border of inwardly facing loop type fastening material along the base opening of the first flexible triangular sleeve portion, and, engaging a border of outwardly facing hook type fastening material on the second transverse edge of the major portion with a border of inwardly facing loop type fastening material along the base opening of the second flexible triangular sleeve portion.

The present invention provides a hammock cover which protects a hammock from the elements of the environment between uses, thereby allowing the hammock to be left slung outdoors for extended periods of time. The hammock cover includes a major portion for covering a body portion of a hammock, a first minor portion for covering a first line portion of a hammock, and a second minor portion for covering a second line portion of a hammock. Once the cover is completely secured to the hammock, only the major portion of the hammock cover need be removed to enable use of the hammock.

BRIEF DESCRIPTION OF THE DRAWINGS

Further details, features and advantages of the present invention will appear from the description which follows with reference to respective drawings in which preferred forms of a hammock cover according to the present invention are shown.

DETAILED DESCRIPTION OF THE PREFERRED EMBODIMENT

Figure 1:
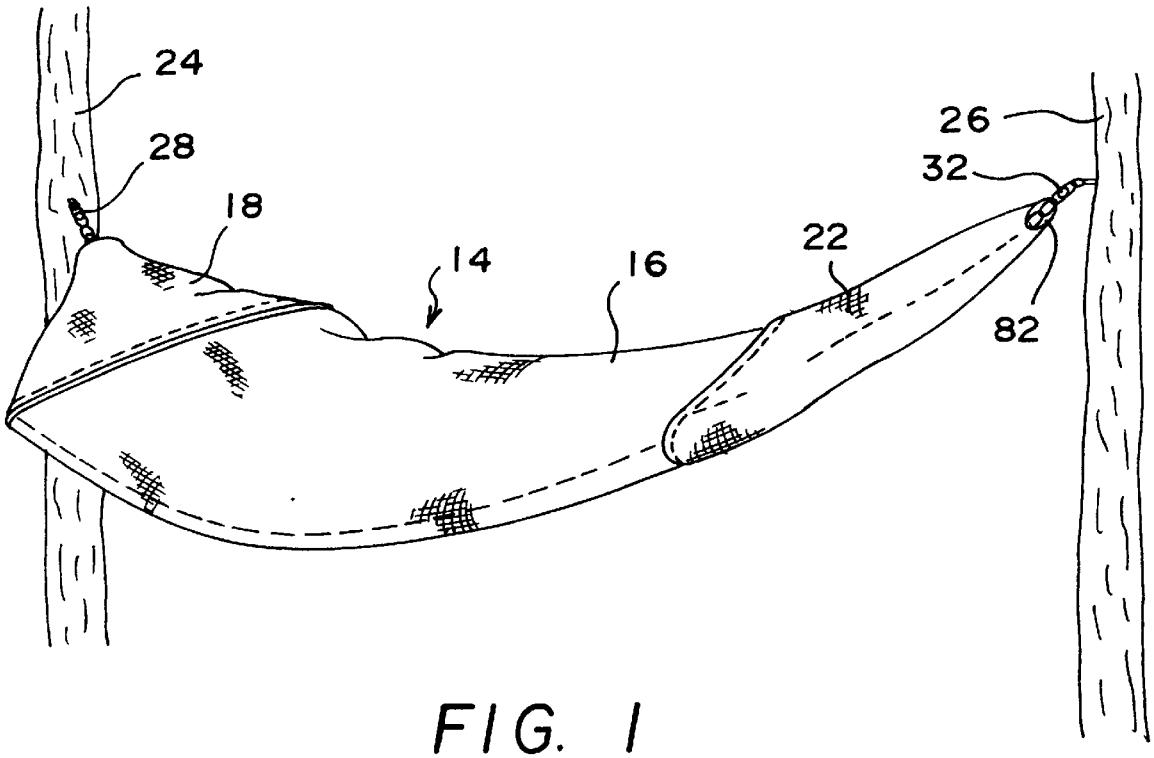
FIG. 1 shows a perspective view of a preferred embodiment of a hammock cover secured to a hammock according to the present invention.
Figure 2:
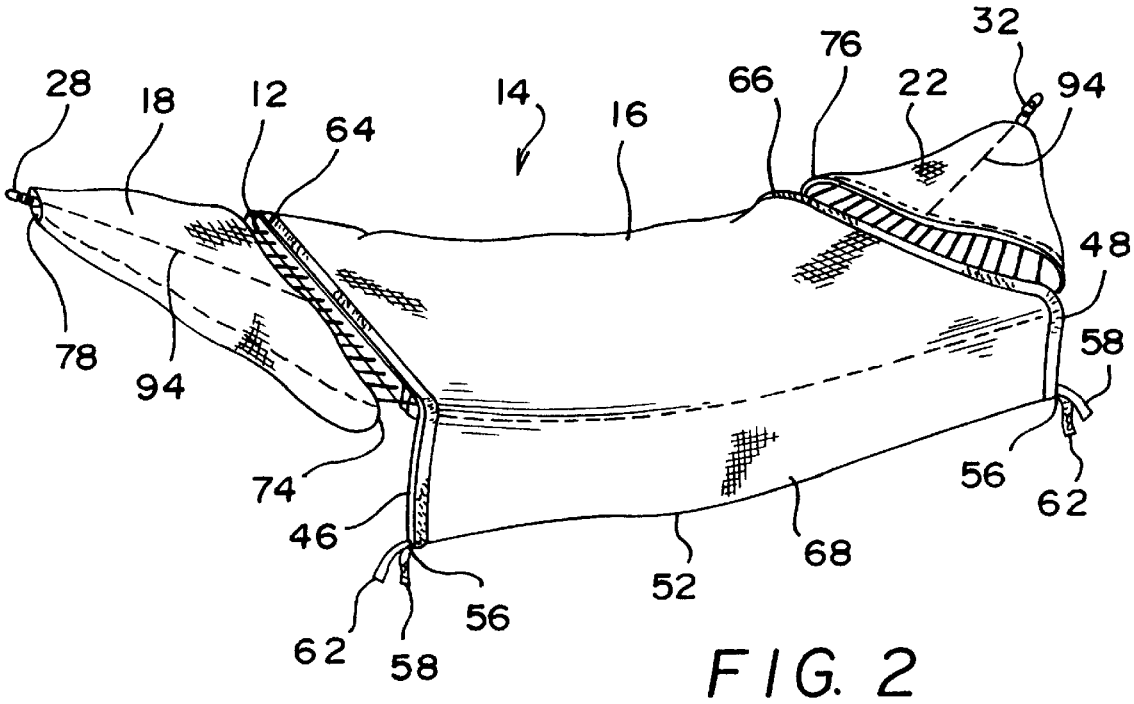
FIG. 2 shows another perspective view of the hammock cover shown in FIG. 1 partially secured to a hammock.

FIGS. 1–5 show a preferred embodiment of a hammock cover 14 according to the present invention in various stages of securement to a conventional hammock according to the present invention. As shown in FIGS. 1 and 2, hammock cover 14 includes a flexible elongated rectangular major portion 16 having a first transverse edge 46 and a second transverse edge 48, a first longitudinal edge 52, and a second longitudinal edge (not shown) substantially identical to first longitudinal edge 52.

First and second transverse edges 46 and 48 are preferably provided with identical sets of equally spaced apart hammock connectors 56. Hammock connectors are configured to connect major portion 16 to hammock 12. Each hammock connector 56 shown in FIGS. 2–5 is stitchedly attached to the transverse edges 46 and 48 of hammock 12 and includes a first strap 58 including loop type fastening material and a second strap 62 including hook type fastening material. Note from FIG. 5 that when the hammock connectors 56 are attached to the spreader bars 34 and 36, the transverse edges 64 and 66 of major portion 16 extend beyond the spreader bars 34 and 36. Thus, major portion 16 of hammock cover 16 may be used with different hammock body portions 38 of varying length.

Other forms of hammock connectors (not shown) may be used with the hammock cover 14 according to the present invention. For example, each transverse edge 46 and 48 of major portion 16 may be provided with sleeves for accepting a drawstring thus allowing each transverse edge 46 and 48 to be cinched against the hammock and tied thereto. As another example, each transverse edge 46 and 48 may be provided with a sleeve for accepting a preformed resilient wire or elastic which causes the transverse edges of major portion 16 to bias into an oval shape, or other appropriate shape for releasably attaching the major portion of the cover to the hammock. Combinations of various different types of hammock connectors may also be used according to the present invention.

As shown in FIG. 2, transverse edges 46 and 48 also preferably include first and second borders 64 and 66, each including outwardly facing hook type fastening material. It is important to note that other forms of releasable fasteners may be provided on first and second borders 64 and 66 of transverse edges 46 and 48, respectively. For example, buttons, snaps, zipper(s), or as another example, sections of rope, may be provided on borders 64 and 66.

Figure 3:
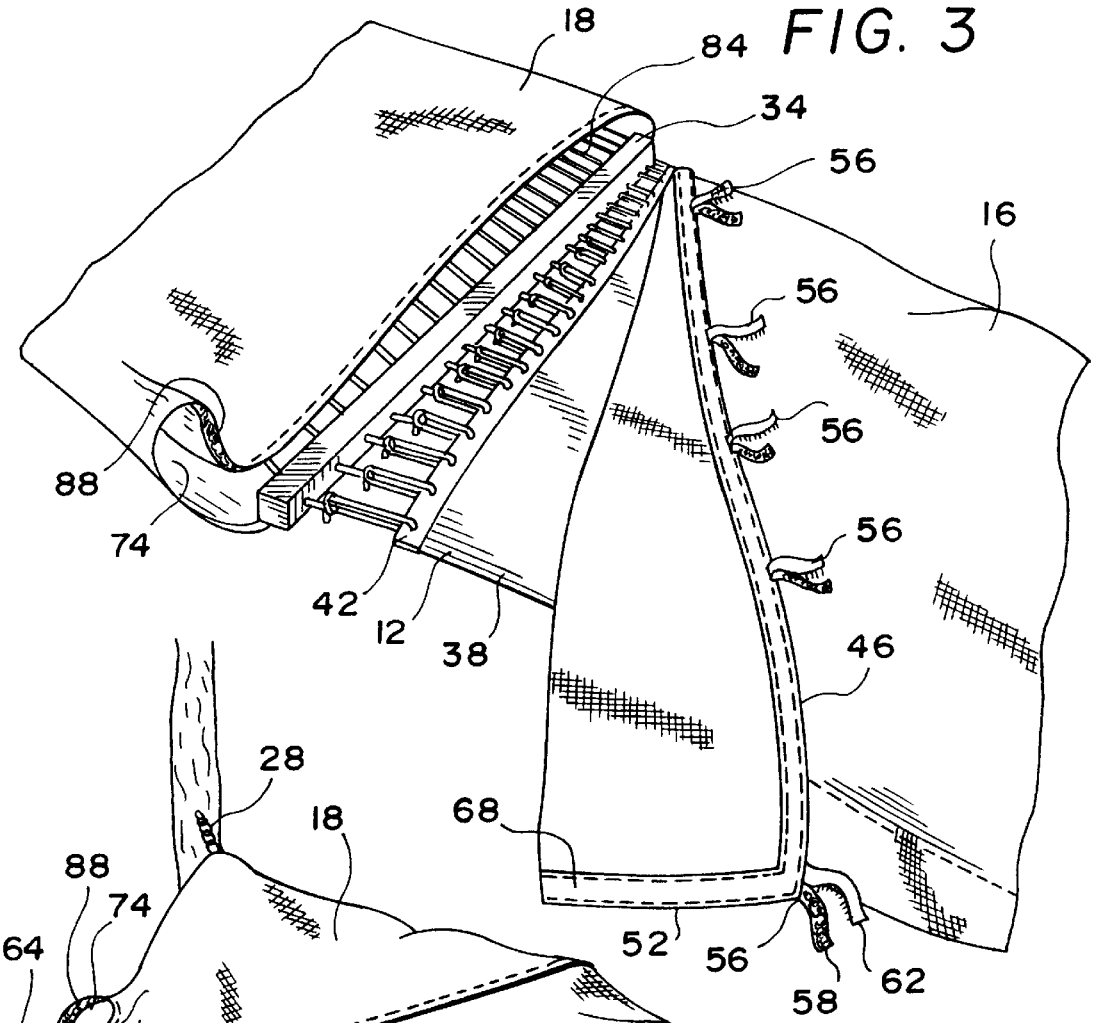
FIG. 3 shows a partial perspective view of the hammock cover shown in FIG. 1 partially secured to a hammock.

Note from FIG. 3 that the first longitudinal edge 52 of major portion 16 includes a border 68 which may also be provided with fasteners, such as those described above. A border (not shown) of second longitudinal edge (not shown) of major portion 18 may be provided with fastener receivers to cooperate with the fasteners of border 68 so that first longitudinal edge 52 may be releasably attached to second longitudinal edge (not shown) below the body portion 38 of hammock 12.

As shown in FIG. 2, hammock cover 14 also includes first and second minor portions 18 and 22, respectively. Preferably, first and second minor portions 18 and 22 are flexible triangular sleeve portions having transverse base openings 74 and 76, respectively, capable of accommodating a transversely oriented spreader bar of a conventional hammock.

First and second minor portions 18 and 22 also include peak openings 78 and 82, respectively, capable of accommodating the leaders 28 and 32, respectively, of a conventional hammock. Note that peak openings 78 and 82 may be provided with borders including sleeves for accepting drawstrings. In such embodiments, the peak openings of first and second minor portions may be cinched against the leaders to further protect the hammock.

Figure 4:
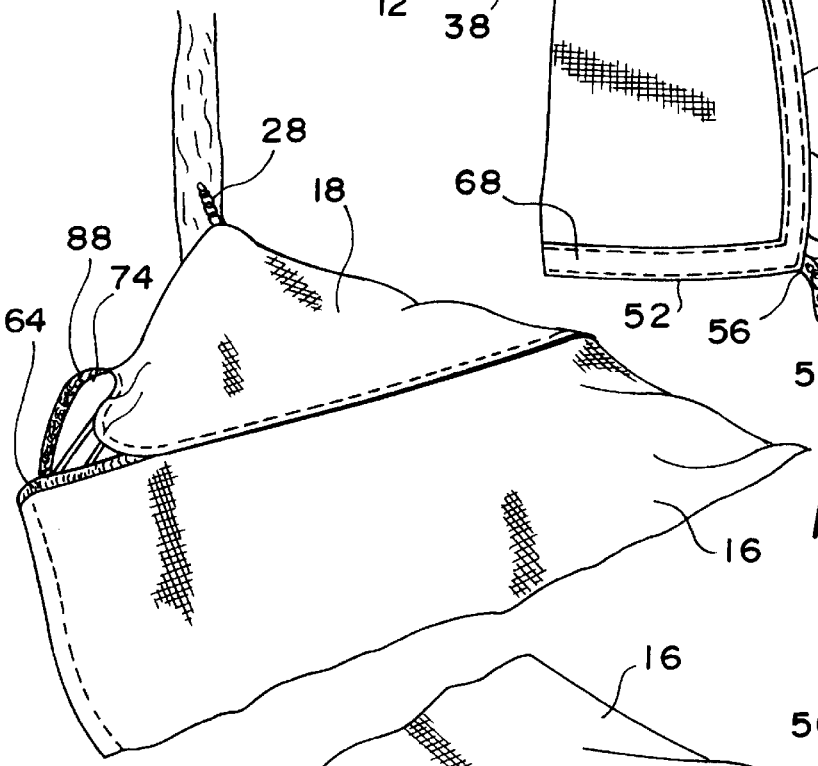
FIG. 4 shows a partial perspective view of the hammock cover shown in FIG. 1 partially secured to a hammock.

Preferably, first minor portion 18 includes a border 88 of inwardly facing loop type fastening material along base opening 74 and second minor portion 22 includes a border (not shown) of inwardly facing loop type fastening material along base opening 76. As shown in FIG. 4, the borders of inwardly facing loop type fastening material on first and second minor portions, 18 and 22, releasably attach to outwardly facing hook type fastening material provided on the borders 64 and 66 of transverse edges 46 and 48, respectively, of the major portion 16.

Note that the borders of base openings 74 and 76, may be configured with fastener receivers to cooperate with any releasable fastener provided on the borders 64 and 66 of transverse edges 46 and 48 of major portion 16. For example, the borders 88 and 92 may be provided with holes for cooperating with buttons or sections of rope provided on the borders 64 and 66, respectively, of major portion 16.

The flexible major portion 16 and first and second minor portions 18 and 22 of hammock cover 14 may be constructed of any flexible material resistant to the elements of the environment. A preferred material for this construction is spunbonded olefin sold under the trademark, TYVEK, by Dupont Corporation. Further, materials may be varied between major portion 16 and first and minor portions 18 and 22. For example, major portion 16 may be constructed of an inelastic material, whereas, first and second minor portions 18 and 22, may be constructed of an elastic material.

A method of using the above-described hammock cover 14 to cover a conventional hammock 12 as shown in FIG. 1, according to the present invention, will now be described. First, the first flexible triangular minor portion 18 is placed over a first leader 28, a first line portion 84 and a first spreader bar 34 of the conventional hammock 12 to releasably attach the first minor portion to the first minor portion 18. To accomplish this, the hammock 12 must be temporarily detached from the first support 28. Then, preferably, the first leader 28 of the hammock is passed through the base opening 74 and out the peak opening 78 of the first minor portion 18 of the hammock cover 14. Once the first leader 28 is sufficiently extended through peak opening 78, the hammock 12 may then be reconnected to first support 24.

First minor portion 18 is then manipulated into position such that first line portion 84 is sufficiently covered. A similar procedure is then followed for placing second flexible triangular minor portion 22 over second leader 28, and second line portion 86. At the end of this portion of the method, the first and second minor portions of the hammock cover are partially secured to the hammock 12 as shown in FIGS. 2 and 3.

In alternative embodiments of the present invention not shown, the first and second minor portions 18 and 22, may each be configured to releasably attach to a hammock without the necessity of detaching the hammock from between the supports. For example, first minor portion 18 may be provided with a longitudinal slit 94 forming first and second longitudinal edges. A border on the first longitudinal edge may be provided with releasable fasteners and a border of the second longitudinal edge may be configured with fastener receivers to cooperate with the fasteners, for securing the minor portion around the first leader and first line portion of the hammock. The second minor portion 22 may be configured similarly.

In a further step, flexible elongated rectangular major portion 16 is placed on the body portion 38 of the hammock 12 such that the first transverse edge 46 is parallel to and covers the first spreader bar 34 of the hammock 12 and the second transverse edge 48 is parallel to and covers a second spreader bar 36 of the hammock 12. Note from FIG. 2, that the hammock cover major portion 16 is configured so that the first longitudinal edge 52 and second longitudinal edge (not shown) substantially overlap the longitudinal edges of the body portion 38 of the hammock 12. Thus, major portion 16 may be used to cover a wide range of hammock body portion widths.

Figure 5:
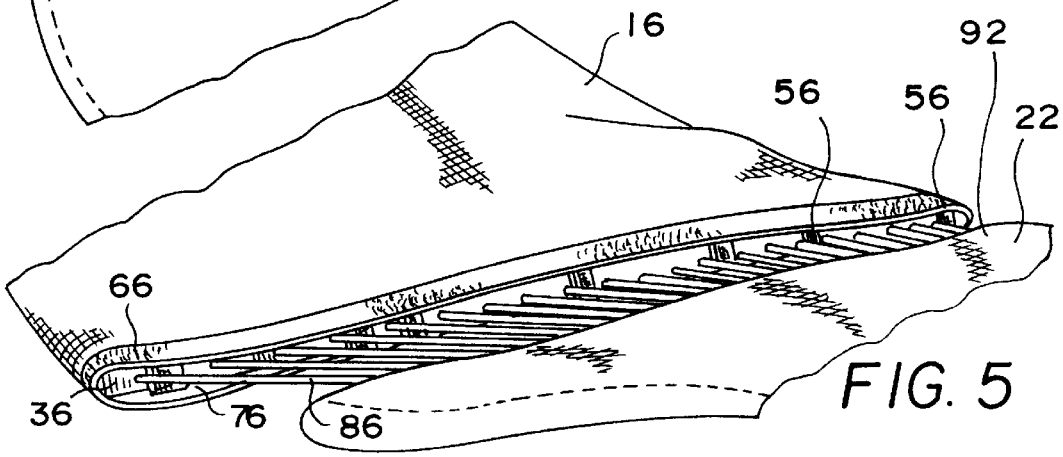
FIG. 5 shows a partial perspective view of the hammock cover shown in FIG. 1 partially secured to a hammock.

Once the major portion is in place, the hammock connecters 56 are secured to the spreader bars 34 and 36 of the hammock 12 such that a preferably single layer of material is formed over first spreader bar 34, second spreader bar 36, and body portion 38, as shown in FIG. 5.

In a further step the border of outwardly facing hook type fastening material on the first transverse edge 46 of major portion 16 is engaged with the border of inwardly facing loop type fastening material along transverse base opening 74 of first minor portion 18 and the border of outwardly facing hook type fastening material on the second transverse edge 48 of major portion 16 is engaged with the border of inwardly facing loop type fastening material along the transverse base opening 76 of second minor portion 22, thereby fully securing the hammock cover 14 to the hammock 12 as shown in FIGS. 1 and 4.

Once hammock cover 14 is fully secured to the hammock 12, the first transverse base opening 74 of first minor portion 18 accommodates first spreader bar 34. Further, border 88 overlaps border 64 of the first transverse edge 46 of the major portion, as shown in FIGS. 1 and 4. Similarly, second minor portion 22 accommodates second spreader bar 36 and border 92 overlaps border 66 of the second transverse edge 48 of the hammock cover.

Note from FIG. 1 that hammock 12 is slightly arcuate such that the center of the body portion of the hammock is significantly lower than the first and second leaders 28 and 32. Thus, any water, debris, or other matter on the hammock cover 14 flows or otherwise moves under the force of gravity or wind, over minor portions 18 and 22 and then directly onto major portion 16, and off the hammock cover. Note that the overlap of first and second minor portions 18 and 22 over the first and second transverse edges 64 and 66, respectively, of major portion 16 prevents any such debris from contacting the hammock 12.

Further, note from FIG. 1, that the upper surfaces of the hammock are entirely covered, including first and second line portions 84 and 86, first and second spreader bars 34 and 36, and body portion 38. However, as shown in FIG. 2, major portion 12 is preferably configured so that first and second borders of longitudinal edges 52 and 54 of major portion 16 do not overlap each other on the underside of hammock 12, thus allowing air to circulate freely underneath the hammock. This prevents the accumulation of moisture due to, for example, condensation, within the cover and problems associated therewith.

What is claimed is:

1. A cover for a hammock, said cover comprising:

a flexible elongated major portion having a first transverse edge and a second transverse edge and configured to releasably attach to a hammock for covering a body portion of said hammock;

a first flexible minor portion configured to releasably attach to a first line portion of said hammock and to substantially overlap said first transverse edge of said major portion for covering said first line portion of said hammock; and, a second flexible minor portion configured to releasably attach to a second line portion of said hammock and to substantially overlap said second transverse edge of said major portion for covering said second line portion of said hammock.

2. The cover according to claim 1 in combination with a hammock.

3. A cover for a hammock according to claim 1, wherein said first transverse edge of said major portion is provided with an at least one hammock connector and said second transverse edge of said major portion is provided with at least one said hammock connector.

4. A cover for a hammock according to claim 3, wherein said at least one hammock connector is a plurality of spaced apart hammock connectors.

5. A cover for a hammock according to claim 4, wherein each said hammock connector is made of a first strap and a second strap which may be releasably secured to each other around a spreader bar of said hammock.

6. A cover for a hammock according to claim 5, wherein said first and second straps of said hammock connectors are provided with respective hook and loop type releasable fastening materials.

7. A cover for a hammock according to claim 6, wherein said first longitudinal edge of said major portion of said hammock cover is configured to releasably attach to said second longitudinal edge of said major portion of said hammock cover below said body portion of said hammock.

8. A cover for a hammock according to claim 7, wherein said major portion of said hammock cover forms a single layer of material substantially fully around said first spreader bar, said second spreader bar, and said body portion of said hammock.

9. A cover for a hammock according to claim 8, wherein said first longitudinal edge of said major portion is provided with a border of hook type fastening material for engaging a border of loop type fastening material on said second longitudinal edge of said major portion.

10. A cover for a hammock according to claim 9, wherein said first and second at least one fasteners are buttons and said first and second at least one fastener receivers are button holes.

11. A cover for a hammock according to claim 10, wherein said first transverse edge of said major portion is provided with a border of outwardly facing loop type fastening material for releasable attachment to a border of inwardly facing hook type fastening material along said base opening of said first flexible triangular sleeve portion; and, said second transverse edge of said major portion is provided with a border of outwardly facing hook type fastening material for releasable attachment to a border of inwardly facing loop type fastening material along said base opening of said second flexible triangular sleeve portion.

12. A cover for a hammock according to claim 11, wherein said first flexible minor portion is provided with a longitudinal slit forming a first longitudinal edge and a second longitudinal edge of said first flexible minor portion;

said second flexible minor portion is provided with a longitudinal slit forming a first longitudinal edge and a second longitudinal edge of said second flexible minor portion; and, said first and second longitudinal edges of said first and second flexible minor portions are configured to releasably attach to each other for securing said minor portions to said line portions of said hammock without detaching the hammock from between two supports.

13. A cover for a hammock according to claim 12, wherein said major portion is made of an elastic material.

14. A cover for a hammock according to claim 13, wherein said first flexible minor portion and said second flexible minor portion are made of an elastic material.

15. A cover for a hammock, said cover comprising:

a flexible elongated rectangular major portion having a first transverse edge provided with a border including an at least one first fastener, a second transverse edge provided with a border including an at least one second fastener, a first longitudinal edge, and a second longitudinal edge;

a first flexible triangular sleeve portion having a transverse base opening accomodating a first spreader bar of said hammock, a peak opening accommodating a first leader of said hammock, and a border including an at least one first fastener receiver along said transverse base opening; and, a second flexible triangular sleeve portion having a transverse base opening accommodating a second spreader bar of said hammock, a peak opening accommodating a second leader of said hammock, and a border including an at least one second fastener receiver along said transverse base opening.

16. A cover for a hammock according to claim 15, wherein said first transverse edge of said major portion is provided with an at least one hammock connector and said second transverse edge of said major portion is provided with at least one said hammock connector.

17. A cover for a hammock according to claim 16, wherein said at least one hammock connector is a plurality of spaced apart hammock connectors.

18. A cover for a hammock according to claim 17, wherein each said hammock connector is made of a first strap and a second strap which may be releasably secured to each other around a spreader bar of said hammock.

19. A cover for a hammock according to claim 18, wherein said first and second straps of said hammock connectors are provided with respective hook and loop type releasable fastening materials.

20. A cover for a hammock according to claim 19, wherein said first longitudinal edge of said major portion of said hammock cover is configured to releasably attach to said second longitudinal edge of said major portion of said hammock cover below said body portion of said hammock.

21. A cover for a hammock according to claim 20, wherein said major portion of said hammock cover forms a single layer of material substantially fully around said first spreader bar, said second spreader bar, and said body portion of said hammock.

22. A cover for a hammock according to claim 21, wherein said first longitudinal edge of said major portion is provided with a border of hook type fastening material for engaging a border of loop type fastening material on said second longitudinal edge of said major portion.

23. A cover for a hammock according to claim 22, wherein said first and second at least one fasteners are buttons and said first and second at least one fastener receivers are button holes.

24. A cover for a hammock according to claim 23, wherein said first transverse edge of said major portion is provided with a border of outwardly facing loop type fastening material for releasable attachment to a border of inwardly facing hook type fastening material along said base opening of said first flexible triangular sleeve portion; and, said second transverse edge of said major portion is provided with a border of outwardly facing hook type fastening material for releasable attachment to a border of inwardly facing loop type fastening material along said base opening of said second flexible triangular sleeve portion.

25. A cover for a hammock according to claim 24, wherein said first triangular sleeve portion is provided with a longitudinal slit forming a first longitudinal edge and a second longitudinal edge of said first triangular sleeve portion;

said second triangular sleeve portion is provided with a longitudinal slit forming a first longitudinal edge and a second longitudinal edge of said second triangular sleeve portion; and, said first and second longitudinal edges of said first and second sleeve portions are configured to releasably attach to each other for securing said sleeve portions to said line portions of said hammock without detaching the hammock from between two supports.

26. A cover for a hammock according to claim 25, wherein said major portion is made of an elastic material.

27. A cover for a hammock according to claim 26, wherein said first triangular sleeve portion and said second triangular sleeve portion are made of an elastic material.

28. The cover according to claim 2 in combination with a hammock.

29. A method of covering a hammock, comprising the steps of placing a first flexible triangular sleeve portion having a transverse base opening capable of accommodating a first spreader bar of said hammock and a peak opening capable of accommodating a first leader of said hammock over said first leader, a first line portion, and said first spreader bar of said hammock;

placing a second flexible triangular sleeve portion having a transverse base opening capable of accommodating a second spreader bar of said hammock and a peak opening capable of accommodating a second leader of said hammock over said second leader, a second line portion, and said second spreader bar of said hammock;

placing a flexible elongated rectangular hammock cover major portion on a body portion of a hammock such that a first transverse edge provided with a plurality of hammock connectors covers a first spreader bar of said hammock, and a second transverse edge provided with a plurality of hammock connectors covers a second spreader bar of said hammock;

connecting said hammock connectors to said first and second spreader bars of said hammock;

engaging an outwardly facing border of hook type fastening material on said first transverse edge of said major portion with an inwardly facing border of loop type fastening material along said base opening of said first flexible triangular sleeve portion; and, engaging an outwardly facing border of hook type fastening material on said second transverse edge of said major portion with an inwardly facing border of loop type fastening material along said base opening of said second flexible triangular sleeve portion.

30. The method of claim 29, further including the step of engaging a border of hook type fastening material along said first longitudinal edge of said major portion with a border of loop type fastening material on said second longitudinal edge of said major portion to create a single layer of cover material around said body portion of said hammock.

* * * * *